US011891574B2

(12) United States Patent
Lange et al.

(10) Patent No.: US 11,891,574 B2
(45) Date of Patent: Feb. 6, 2024

(54) RECOVERY OF ALIPHATIC HYDROCARBONS

(71) Applicant: SHELL OIL COMPANY, Houston, TX (US)

(72) Inventors: Jean-Paul Andre Marie Joseph Ghislain Lange, Amsterdam (NL); Luis Alberto Grau Lisnier, Amsterdam (NL); Willem Derks, Amsterdam (NL); Kai Jürgen Fischer, Amsterdam (NL)

(73) Assignee: SHELL USA, INC., Houston, TX (US)

( * ) Notice: Subject to any disclaimer, the term of this patent is extended or adjusted under 35 U.S.C. 154(b) by 70 days.

(21) Appl. No.: 17/441,380

(22) PCT Filed: Apr. 14, 2020

(86) PCT No.: PCT/EP2020/060410
§ 371 (c)(1),
(2) Date: Sep. 21, 2021

(87) PCT Pub. No.: WO2020/212315
PCT Pub. Date: Oct. 22, 2020

(65) Prior Publication Data

US 2022/0177786 A1 Jun. 9, 2022

(30) Foreign Application Priority Data

Apr. 18, 2019 (EP) ..... 19170263

(51) Int. Cl.
*C10G 1/00* (2006.01)
*C10G 21/02* (2006.01)
(Continued)

(52) U.S. Cl.
CPC ..... *C10G 1/002* (2013.01); *C10G 21/006* (2013.01); *C10G 21/02* (2013.01); *C10G 55/04* (2013.01); *C10G 1/10* (2013.01)

(58) Field of Classification Search
CPC ..... C10G 1/002; C10G 21/02; C10G 21/16; C10G 21/20; C10G 21/27; C10G 21/28; C10G 53/04; C10G 55/04
See application file for complete search history.

(56) References Cited

U.S. PATENT DOCUMENTS 2,600,184 A 6/1952 Arnold et al.
3,864,245 A 2/1975 Van Tassell
(Continued)

FOREIGN PATENT DOCUMENTS

CA 1246483 A 12/1988
CA 2214305 A1 2/1999
(Continued)

OTHER PUBLICATIONS

International Search Report and Written Opinion received for PCT Patent Application No. PCT/EP2020/060410, dated May 4, 2020, 09 pages.
(Continued)

*Primary Examiner* — Renee Robinson
(74) *Attorney, Agent, or Firm* — SHELL USA, INC.

(57) ABSTRACT

The invention relates to a process for the recovery of aliphatic hydrocarbons from a liquid hydrocarbon feedstock stream, which comprises aliphatic hydrocarbons and additionally comprises aromatic hydrocarbons and/or polar components, said process comprising the steps of: feeding the liquid hydrocarbon feedstock stream to a first column; feeding a first solvent stream which comprises an organic solvent to the first column at a position which is higher than the position at which the liquid hydrocarbon feedstock stream is fed; contacting at least a portion of the liquid hydrocarbon feedstock stream with at least a portion of the first solvent stream; and recovering at least a portion of the aliphatic hydrocarbons by liquid-liquid extraction of aromatic hydrocarbons and/or polar components with organic
(Continued)

solvent, resulting in a stream comprising recovered aliphatic hydrocarbons and optionally organic solvent and a bottom stream from the first column comprising organic solvent and aromatic hydrocarbons and/or polar components.

4 Claims, 3 Drawing Sheets

(51) Int. Cl.

| | |
|---|---|
| ***C10G 55/04*** | (2006.01) |
| ***C10G 21/00*** | (2006.01) |
| *C10G 1/10* | (2006.01) |

(56) References Cited

U.S. PATENT DOCUMENTS

| | | | |
|---|---|---|---|
| 4,353,794 | A | 10/1982 | Winter, III et al. |
| 4,764,256 | A | 8/1988 | Way |
| 4,992,210 | A | 2/1991 | Naeger et al. |
| 5,114,566 | A | 5/1992 | Naeger et al. |
| 5,354,930 | A | 10/1994 | Atkins et al. |
| 5,399,244 | A | 3/1995 | Gentry et al. |
| 5,731,483 | A | 3/1998 | Stabel et al. |
| 8,551,328 | B2 | 10/2013 | Maglio et al. |
| 8,709,233 | B2 | 4/2014 | Mccoy et al. |
| 8,851,328 | B2 | 10/2014 | Schoeley et al. |
| 8,961,780 | B1 | 2/2015 | Yusuf et al. |
| 9,781,747 | B2 | 10/2017 | Kim et al. |
| 9,839,897 | B2 | 12/2017 | Lacheen |
| 10,767,122 | B2 | 9/2020 | Oprins et al. |
| 10,927,315 | B2 | 2/2021 | Ramamurthy et al. |
| 2002/0096451 | A1 | 7/2002 | Ackerson et al. |
| 2008/0194900 | A1 | 8/2008 | Bhirud |
| 2009/0107890 | A1 | 4/2009 | Hamad et al. |
| 2010/0300932 | A1 | 12/2010 | Debuisschert et al. |
| 2011/0155645 | A1 | 6/2011 | Serban et al. |
| 2013/0153394 | A1 | 6/2013 | Wieser-linhert |
| 2013/0220884 | A1 | 8/2013 | Bourane et al. |
| 2014/0005459 | A1 | 1/2014 | Zhan et al. |
| 2014/0336427 | A1 | 11/2014 | Baird et al. |
| 2016/0369184 | A1 | 12/2016 | Ward et al. |
| 2016/0369190 | A1 | 12/2016 | Ward et al. |
| 2018/0187087 | A1 | 7/2018 | Atkins et al. |
| 2018/0355256 | A1 | 12/2018 | Dooley |
| 2019/0062646 | A1 | 2/2019 | Hakeem et al. |
| 2019/0161683 | A1 | 5/2019 | Narayanaswamy et al. |
| 2019/0177626 | A1 | 6/2019 | Ramamurthy et al. |
| 2020/0080009 | A1 | 3/2020 | Derks |
| 2022/0135502 | A1 | 5/2022 | Vongachariya et al. |

FOREIGN PATENT DOCUMENTS

| | | | |
|---|---|---|---|
| CN | 103571537 | A | 2/2014 |
| CN | 106833719 | A | 6/2017 |
| EP | 0697455 | A2 | 2/1996 |
| EP | 3907267 | A1 | 11/2021 |
| GB | 1248814 | A | 10/1971 |
| GB | 1554767 | A | 10/1979 |
| GB | 2040306 | A | 8/1980 |
| JP | S4928642 | B1 | 7/1974 |
| WO | 0046322 | A1 | 8/2000 |
| WO | 2010070029 | A1 | 6/2010 |
| WO | 2013002887 | A1 | 1/2013 |
| WO | 2017167948 | A1 | 10/2017 |
| WO | 2018025104 | A1 | 2/2018 |
| WO | 2021110395 | A1 | 6/2021 |

OTHER PUBLICATIONS

Office Action Received for Chinese Application No. 201780075338.5, dated Apr. 26, 2021, 16 pages (8 pages of English Translation and 8 pages of Official Copy).

International Search Report and Written Opinion received for PCT Patent Application No. PCT/EP2017/081817 dated Feb. 19, 2018, 09 pages.

Muhammad et al. "Catalytic Pyrolysis of Waste Plastic From Electrical and Electronic Equipment" Journal of Analytical and Applied Pyrolysis, vol. 113, 2015, pp. 332-339.

Banerjee, "Thermal Processing of Hydrocarbons—Petroleum to Petrochemicals", 2019, 4.4.2 Furnace Design, 18 pages.

Li et al. "Analysis and Comparison of Nitrogen Compounds in Different Liquid Hydrocarbon Streams Derived from Petroleum and Coal" Energy& Fuels, vol. 24, Issue No. 10, Oct. 4, 2010, pp. 5539-5547.

Xianglin et al. "China Refining Technology", Jul. 31, 2001, pp. 327-328.

Williams et al., "Fluidised Bed Pyrolysis of Low Density Polyethylene to Produce Petrochemical Feedstock", Journal of Analytical and Applied Pyrolysis, Jul. 1999, vol. 51, Issue No. 1-2, pp. 107-126.

Communication Pursuant to Rule 114(2) EPC Received for EP Application No. 20817002.7, dated Jan. 5, 2023, 5 Pages.

Office Action Received for Eurasian Application No. 202290394, dated Feb. 7, 2023, 4 Pages (2 Pages of English Translation and 2 Pages of Official Copy).

Office Action Received for Chinese Application No. 2020800289763, dated Aug. 1, 2022, 20 Pages(11 Pages of English Translation and 09 Pages of Official Copy).

Siddiqui et al., "Pyrolysis of Mixed Plastics for the Recovery of Useful Products", Fuel Processing Technology, vol. 90, Issue No. 4, Apr. 2009, pp. 545-552.

International Search Report and Written Opinion received for PCT Patent Application No. PCT/EP2020/084802, dated Mar. 10, 2021, 10 pages.

International Search Report and Written Opinion received for PCT Patent Application No. PCT/US2020/043426, dated Aug. 28, 2020, 11 pages.

Office Action Received for European Application No. 20751833.3, dated Aug. 24, 2023, 5 Pages.

Notice of Allowance Received for U.S. Appl. No. 16/467,294 dated Nov. 29, 2023, 12 Pages.

RECOVERY OF ALIPHATIC HYDROCARBONS

CROSS REFERENCE TO RELATED APPLICATIONS

This is a National stage application of International application No. PCT/EP2020/060410, filed 14 Apr. 2020, which claims priority of European application No. 19170263.8, filed 18 Apr. 2019, which is incorporated herein by reference in its entirety.

FIELD OF THE INVENTION

The present invention relates to a process for the recovery of aliphatic hydrocarbons from a liquid stream comprising aliphatic hydrocarbons, aromatic hydrocarbons and polar components.

BACKGROUND OF THE INVENTION

Waste plastics can be converted via pyrolysis to high-value chemicals, including olefins and aromatic hydrocarbons. Pyrolysis of plastics can yield product streams having a wide boiling range, including gaseous and liquid product streams. Hydrocarbons from liquid pyrolysis product streams can be cracked to produce high-value chemicals, including ethylene and propylene which are monomers that can be used in making new plastics.

WO2018069794 discloses a process for producing olefins and aromatic hydrocarbons from plastics wherein a liquid pyrolysis product stream is separated into a first fraction having a boiling point <300° C. and a second fraction having a boiling point ≥300° C. Only said first fraction is fed to a liquid steam cracker, whereas said second fraction is recycled to the pyrolysis unit. In the process shown in FIG. 1 of WO2018069794, said separation is performed in a hydrocarbon liquid distillation unit. Having to separate the liquid pyrolysis product stream into two fractions is cumbersome (e.g. energy intensive). A further disadvantage is that the heavier portion of the liquid pyrolysis product stream has to be sent back to the pyrolysis unit for a deeper pyrolysis. This results in yield loss through the formation of gas and an increasing amount of solid side-product (coke) which is eventually not sent to the steam cracker. In one embodiment of the process of above-mentioned WO2018069794 (see FIG. 2), the first fraction having a boiling point <300° C. is first conveyed together with hydrogen to a hydroprocessing unit to produce a treated hydrocarbon liquid stream which is then fed to the liquid steam cracker. Such hydroprocessing is also cumbersome, as it is capital intensive and requires the use of expensive hydrogen ($H_2$).

There is an ongoing need to develop improved processes for the recovery of aliphatic hydrocarbons from liquid streams comprising aliphatic hydrocarbons, aromatic hydrocarbons and polar components which may originate from the pyrolysis of waste plastics, in specific mixed waste plastics. It is an object of the present invention to provide such process for the recovery of aliphatic hydrocarbons from a liquid stream comprising aliphatic hydrocarbons, aromatic hydrocarbons and polar components, which is technically advantageous, efficient and affordable, in particular a process which does not have one or more of the above-mentioned disadvantages. Such technically advantageous process would preferably result in a relatively low energy demand and/or relatively low capital expenditure.

SUMMARY OF THE INVENTION

Surprisingly it was found by the present inventors that such process can be provided by contacting at least a portion of a liquid stream which comprises aliphatic hydrocarbons and additionally comprises aromatic hydrocarbons and/or polar components, with at least a portion of a first solvent stream which comprises an organic solvent, resulting in liquid-liquid extraction and in recovery of at least a portion of the aliphatic hydrocarbons.

Advantageously, in the present invention, there is no need for hydrotreating (treatment with $H_2$) because of said liquid-liquid extraction. Furthermore, advantageously, a liquid hydrocarbon stream having a wide boiling range, such as pyrolysis oil, may be treated in the present process with a relatively low yield loss and feed degradation. This implies that the costs of a hydrocarbon feed to a steam cracker may be reduced considerably by applying the present invention.

Accordingly, the present invention relates to a process for the recovery of aliphatic hydrocarbons from a liquid hydrocarbon feedstock stream, which comprises aliphatic hydrocarbons and additionally comprises aromatic hydrocarbons and/or polar components, said process comprising the steps of:

feeding the liquid hydrocarbon feedstock stream to a first column;

feeding a first solvent stream which comprises an organic solvent to the first column at a position which is higher than the position at which the liquid hydrocarbon feedstock stream is fed;

contacting at least a portion of the liquid hydrocarbon feedstock stream with at least a portion of the first solvent stream; and recovering at least a portion of the aliphatic hydrocarbons by liquid-liquid extraction of aromatic hydrocarbons and/or polar components with organic solvent, resulting in a stream comprising recovered aliphatic hydrocarbons and optionally organic solvent and a bottom stream from the first column comprising organic solvent and aromatic hydrocarbons and/or polar components.

Further, the present invention relates to a process for steam cracking a hydrocarbon feed, wherein the hydrocarbon feed comprises aliphatic hydrocarbons recovered in the above-mentioned process of the present invention.

WO2018104443 discloses a method of pretreating a hydrocarbon steam cracker feed, comprising contacting the feed with a solvent to produce a pretreated feed having a reduced content of fouling components that cause fouling in the preheat, convection and radiant sections of the steam cracker and a rich solvent having an increased content of fouling components. According to WO2018104443, the hydrocarbon steam cracker feed may comprise pyrolysis oil from plastic waste. Further, according to WO2018104443, the fouling components may comprise polycyclic aromatics, resins or a mixture thereof.

DETAILED DESCRIPTION OF THE INVENTION

Figure 1:
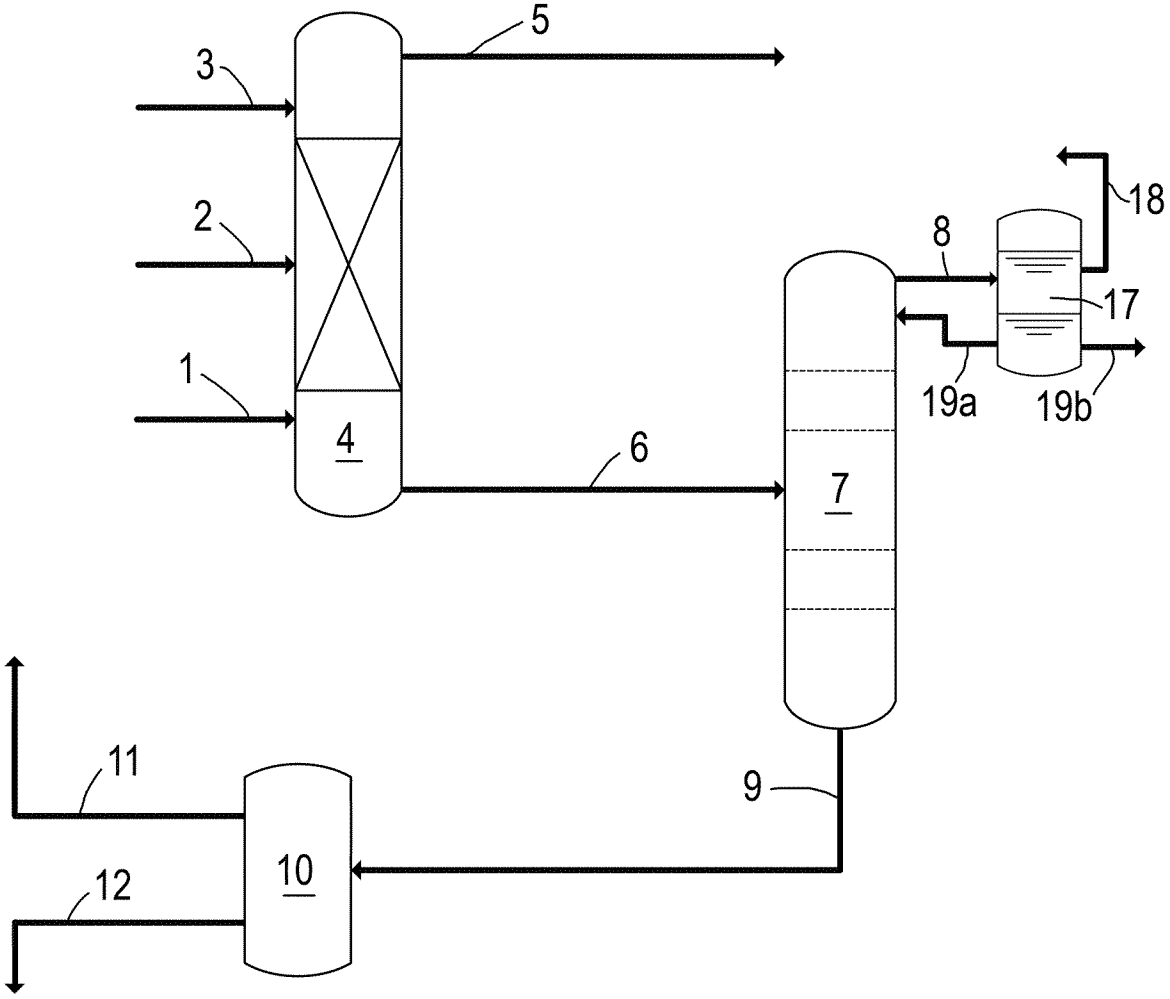
FIG. 1 shows one embodiment of the process for the recovery of aliphatic hydrocarbons in accordance with the present invention.

While the process of the present invention and the stream(s) used in said process are described in terms of "comprising", "containing" or "including" one or more various described steps and components, respectively, they can also "consist essentially of" or "consist of" said one or more various described steps and components, respectively.".

In the context of the present invention, in a case where a stream comprises two or more components, these components are to be selected in an overall amount not to exceed 100%.

Further, where upper and lower limits are quoted for a property then a range of values defined by a combination of any of the upper limits with any of the lower limits is also implied.

Within the present specification, by "substantially no" in relation to the amount of a specific component in a stream, it is meant an amount which is at most 1,000, preferably at most 500, more preferably at most 100, more preferably at most 50, more preferably at most 30, more preferably at most 20, and most preferably at most 10 ppmw (parts per million by weight) of the component in question, based on the amount (i.e. weight) of said stream.

Within the present specification, by "top stream" or "bottom stream" from a column reference is made to a stream which exits the column at a position, which is between 0% and 30%, more suitably between 0% and 20%, even more suitably between 0% and 10%, based on the total column length, from the top of the column or the bottom of the column, respectively.

Unless indicated otherwise, where in the present specification reference is made to a boiling point this means the boiling point at 760 mm Hg pressure.

In the present process for the recovery of aliphatic hydrocarbons, at least a portion of a liquid stream which comprises aliphatic hydrocarbons and additionally comprises aromatic hydrocarbons and/or polar components (also herein referred to as the "liquid hydrocarbon feedstock stream") is subjected to liquid-liquid extraction by contacting with at least a portion of a first solvent stream which comprises an organic solvent. Preferably, the liquid hydrocarbon feedstock stream comprises both aliphatic hydrocarbons having a boiling point of from 30 to 300° C. and aliphatic hydrocarbons having a boiling point of from greater than 300 to 600° C. in a weight ratio of from 99:1 to 1:99. The amount of aliphatic hydrocarbons having a boiling point of from 30 to 300° C., based on the total amount of aliphatic hydrocarbons having a boiling point of from 30 to 600° C., may be at most 99 wt. % or at most 80 wt. % or at most 60 wt. % or at most 40 wt. % or at most 30 wt. % or at most 20 wt. % or at most 10 wt. %. Further, the amount of aliphatic hydrocarbons having a boiling point of from 30 to 300° C., based on the total amount of aliphatic hydrocarbons having a boiling point of from 30 to 600° C., may be at least 1 wt. % or at least 5 wt. % or at least 10 wt. % or at least 20 wt. % or at least 30 wt. %.

Thus, advantageously, the liquid hydrocarbon feedstock stream may comprise varying amounts of aliphatic hydrocarbons within a wide boiling point range of from 30 to 600° C. Accordingly, as with the boiling point, the carbon number of the aliphatic hydrocarbons in the liquid hydrocarbon feedstock stream may also vary within a wide range, for example of from 5 to 50 carbon atoms. The carbon number of the aliphatic hydrocarbons in the liquid hydrocarbon feedstock stream may be at least 4 or at least 5 or at least 6 and may be at most 50 or at most 40 or at most 30 or at most 20.

The amount of aliphatic hydrocarbons in the liquid hydrocarbon feedstock stream, based on the total weight of the liquid hydrocarbon feedstock stream, may be at least 30 wt. % or at least 50 wt. % or at least 80 wt. % or at least 90 wt. % or at least 95 wt. % or at least 99 wt. % and may be smaller than 100 wt. % or at most 99 wt. % or at most 90 wt. % or at most 80 wt. % or at most 70 wt. %. The aliphatic hydrocarbons may be cyclic, linear and branched.

The aliphatic hydrocarbons in the liquid hydrocarbon feedstock stream may comprise non-olefinic (paraffinic) and olefinic aliphatic compounds. The amount of paraffinic aliphatic compounds in the liquid hydrocarbon feedstock stream, based on the total weight of the liquid hydrocarbon feedstock stream, may be at least 20 wt. % or at least 40 wt. % or at least 60 wt. % or at least 80 wt. % and may be smaller than 100 wt. % or at most 99 wt. % or at most 80 wt. % or at most 60 wt. %. Further, the amount of olefinic aliphatic compounds in the liquid hydrocarbon feedstock stream, based on the total weight of the liquid hydrocarbon feedstock stream, may be smaller than 100 wt. % or at least 20 wt. % or at least 40 wt. % or at least 60 wt. % or at least 80 wt. % and may be at most 99 wt. % or at most 80 wt. % or at most 60 wt. %.

Further, the olefinic compounds may comprise aliphatic compounds having one carbon-carbon double bond (mono-olefins) and/or aliphatic compounds having two or more carbon-carbon double bonds which latter compounds may be conjugated or non-conjugated. The aliphatic compounds having two or more carbon-carbon double bonds may include compounds having double bonds at alpha and omega positions. The amount of mono-olefins in the liquid hydrocarbon feedstock stream, based on the total weight of the liquid hydrocarbon feedstock stream, may be at least 20 wt. % or at least 40 wt. % or at least 60 wt. % or at least 80 wt. % and may be smaller than 100 wt. % or at most 99 wt. % or at most 80 wt. % or at most 60 wt. %. Further, the amount of conjugated aliphatic compounds having two or more carbon-carbon double bonds in the liquid hydrocarbon feedstock stream, based on the total weight of the liquid hydrocarbon feedstock stream, may be greater than 0 wt. % or at least 10 wt. % or at least 20 wt. % or at least 40 wt. % or at least 60 wt. % and may be at most 80 wt. % or at most 60 wt. % or at most 40 wt. %.

In addition to the above-described aliphatic hydrocarbons, the liquid hydrocarbon feedstock stream comprises aromatic hydrocarbons and/or polar components.

The amount of aromatic hydrocarbons in the liquid hydrocarbon feedstock stream, based on the total weight of the liquid hydrocarbon feedstock stream, may be greater than 0 wt. % or at least 5 wt. % or at least 10 wt. % or at least 15 wt. % or at least 20 wt. % or at least 25 wt. % or at least 30 wt. % and may be at most 50 wt. % or at most 40 wt. % or at most 30 wt. % or at most 20 wt. %. The aromatic hydrocarbons may comprise monocyclic and/or polycyclic aromatic hydrocarbons. An example of a monocyclic aromatic hydrocarbon is styrene. The polycyclic aromatic hydrocarbons may comprise non-fused and/or fused polycyclic aromatic hydrocarbons. An example of a non-fused polycyclic aromatic hydrocarbon is oligostyrene. Styrene and oligostyrene may originate from polystyrene. Examples of fused polycyclic aromatic hydrocarbons are naphthalene and anthracene. The aromatic ring or rings in the aromatic hydrocarbons may be substituted by one or more hydrocarbyl groups, including alkyl groups (saturated) and alkylene groups (unsaturated). Within the present specification, an aromatic hydrocarbon which contains one or more heteroatoms is a "polar component" as further described below.

Further, the amount of polar components in the liquid hydrocarbon feedstock stream, based on the total weight of the liquid hydrocarbon feedstock stream, may be greater than 0 wt. % or at least 0.5 wt. % or at least 1 wt. % or at least 3 wt. % or at least 5 wt. % or at least 10 wt. % or at least 15 wt. % or at least 20 wt. % and may be at most 30 wt. % or at most 20 wt. % or at most 10 wt. % or at most 5 wt. %. The polar components comprise salts and/or heteroatom containing organic compounds. The salts may comprise organic and/or inorganic salts. The salts may comprise ammonium, an alkali metal, an alkaline earth metal or a transition metal as the cation and a carboxylate, sulphate, phosphate or a halide as the anion. The heteroatom containing organic compounds contain one or more heteroatoms, which may be oxygen, nitrogen, sulfur and/or a halogen. The heteroatom containing organic compounds may comprise amines, amides, nitriles, ethers, esters and acids. Further, the heteroatom containing organic compounds may be aliphatic or aromatic. Aromatic, heteroatom containing organic compounds may comprise monocyclic and/or polycyclic aromatic, heteroatom containing organic compounds. Examples of monocyclic aromatic, heteroatom containing organic compounds are terephthalic acid and benzoic acid. An example of a polycyclic aromatic, heteroatom containing organic compound is oligomeric polyethylene terephthalate (PET). Terephthalic acid, benzoic acid and oligomeric PET may originate from polyethylene terephthalate.

In the present invention, the liquid hydrocarbon feedstock stream may comprise a liquid product produced by the pyrolysis of plastic waste, preferably mixed plastic waste. Such liquid product may be provided in any known way, for example by the process as disclosed in above-mentioned WO2018069794.

In the present invention, the liquid hydrocarbon feedstock stream is fed to a first column. Further, a first solvent stream which comprises an organic solvent is fed to the first column at a position which is higher than the position at which the liquid hydrocarbon feedstock stream is fed.

The weight ratio of the first solvent stream to the liquid hydrocarbon feedstock stream may be at least 0.05:1 or at least 0.2:1 or at least 0.5:1 or at least 1:1 or at least 2:1 or at least 3:1 and may be at most 5:1 or at most 3:1 or at most 2:1 or at most 1:1. Further, the temperature in the first column may be at least 0° C. or at least 20° C. or at least 30° C. or at least 40° C. or at least 50° C. and may be at most 200° C. or at most 150° C. or at most 100° C. or at most 70° C. or at most 60° C. or at most 50° C. or at most 40° C. The pressure in the first column may be at least 100 mbara or at least 500 mbara or at least 1 bara or at least 1.5 bara or at least 2 bara and may be at most 20 bara or at most 15 bara or at most 10 bara or at most 5 bara or at most 3 bara or at most 2 bara or at most 1.5 bara. The temperature and pressure in the first column are preferably such that the content of the first column is in the liquid state.

Further, in the present invention, at least a portion of the liquid hydrocarbon feedstock stream is contacted in the first column with at least a portion of the first solvent stream to effect liquid-liquid extraction. Within the present specification, said "first column" may also be referred to as "first extraction column".

In the present invention, at least a portion of the aliphatic hydrocarbons is recovered by liquid-liquid extraction of aromatic hydrocarbons and/or polar components with organic solvent. Further, preferably, the recovered aliphatic hydrocarbons comprise aliphatic hydrocarbons having a boiling point of from 30 to 300° C. and aliphatic hydrocarbons having a boiling point of from greater than 300 to 600° C. in a weight ratio of from 99:1 to 1:99. The above description of the weight ratio of aliphatic hydrocarbons having a boiling point of from 30 to 300° C. to aliphatic hydrocarbons having a boiling point of from greater than 300 to 600° C. in relation to aliphatic hydrocarbons in the liquid hydrocarbon feedstock stream also applies to the recovered aliphatic hydrocarbons.

In the present invention, said liquid-liquid extraction results in a stream comprising recovered aliphatic hydrocarbons and optionally organic solvent and a bottom stream from the first column comprising organic solvent and aromatic hydrocarbons and/or polar components. Within the present specification, the former stream comprising recovered aliphatic hydrocarbons and optionally organic solvent may also be referred to as a "raffinate stream" and the latter bottom stream may also be referred to as an "extract stream". Such raffinate stream has a reduced content of aromatic hydrocarbons, conjugated aliphatic compounds having two or more carbon-carbon double bonds, and polar components. Such raffinate stream comprises no or at most 10 wt. % or at most 5 wt. % or at most 1 wt. % or substantially no aromatic hydrocarbons. Further, such raffinate stream comprises no or at most 15 wt. % or at most 10 wt. % or at most 5 wt. % or at most 1 wt. % or substantially no conjugated aliphatic compounds having two or more carbon-carbon double bonds. Further, such raffinate stream comprises no or at most 1 wt. % or substantially no polar components.

The organic solvent in the first solvent stream as fed to the first column in the present process, preferably has a density which is at least 3% or at least 5% or at least 8% or at least 10% or at least 15% or at least 20% and at most 50% or at most 40% or at most 35% or at most 30% higher than the density of the liquid hydrocarbon feedstock stream.

Further, it is preferred that the organic solvent in the first solvent stream contains one or more heteroatoms, which may be oxygen, nitrogen and/or sulfur. Still further, it is preferred that said organic solvent is thermally stable at a temperature of 200° C. Still further, said organic solvent may have a boiling point which is at least 50° C. or at least 80° C. or at least 100° C. or at least 120° C. and at most 300° C. or at most 200° C. or at most 150° C.

In specific, the organic solvent in the first solvent stream may be selected from the group consisting of diols and triols, including monoethylene glycol (MEG), monopropylene glycol (MPG) and any isomer of butanediol; glycol ethers, including oligoethylene glycols, including diethylene glycol and tetraethylene glycol, and ethers thereof, including diethylene glycol dimethylether; amides, including N-alkylpyrrolidone, wherein the alkyl group may contain 1 to 8 or 1 to 3 carbon atoms, including N-methylpyrrolidone (NMP), and dialkyl formamide, wherein the alkyl group may contain 1 to 8 or 1 to 3 carbon atoms, including dimethyl formamide (DMF); dialkylsulfoxide, wherein the alkyl group may contain 1 to 8 or 1 to 3 carbon atoms, including dimethylsulfoxide (DMSO); sulfolane; N-formyl morpholine (NFM); and furan ring containing components, including furfural, 2-methyl-furan and furfuryl alcohol. More preferably, the organic solvent in the first solvent stream is above-mentioned N-alkylpyrrolidone, in specific NMP, or a furan ring containing component, in specific furfural. Most preferably, said solvent is NMP. An aqueous solution of a quarternary ammonium salt, in specific trioctyl methyl ammonium chloride or methyl tributyl ammonium chloride, may also be used as the organic solvent in the first solvent stream.

Further, the organic solvent in the first solvent stream may have a Hansen solubility parameter distance $R_{a,heptane}$ with respect to heptane as determined at 25° C. of at least 10 $MPa^{1/2}$, preferably at least 15 $MPa^{1/2}$, and at most 30 $MPa^{1/2}$, preferably at most 25 $MPa^{1/2}$. Still further, the organic solvent in the first solvent stream may have a difference in Hansen solubility parameter distance $R_{a,heptane}$ with respect to heptane compared to Hansen solubility parameter distance $R_{a,toluene}$ with respect to toluene (i.e. $R_{a,heptane}-R_{a,toluene}$) as determined at 25° C. of at least 1.5 $MPa^{1/2}$, preferably at least 2 $MPa^{1/2}$, and at most 4.5 $MPa^{1/2}$, preferably at most 4 $MPa^{1/2}$. In specific, it is preferred that the organic solvent in the first solvent stream has an $R_{a,heptane}$ of at least 10 $MPa^{1/2}$ or at least 15 $MPa^{1/2}$ and a difference in $R_{a,heptane}$ compared to $R_{a,toluene}$ (i.e. $R_{a,heptane}-R_{a,toluene}$) 0 f at most 4.5 $MPa^{1/2}$ or at most 4 $MPa^{1/2}$.

Hansen solubility parameters (HSP) can be used as a means for predicting the likeliness of one component compared to another component. More specifically, each component is characterized by three Hansen parameters, each generally expressed in $MPa^{0.5}$: $\delta_d$, denoting the energy from dispersion forces between molecules; $\delta_p$, denoting the energy from dipolar intermolecular forces between molecules; and $\delta_h$, denoting the energy from hydrogen bonds between molecules. The affinity between compounds can be described using a multidimensional vector that quantifies these solvent atomic and molecular interactions, as a Hansen solubility parameter (HSP) distance $R_a$ which is defined in Equation (1):

$$(R_a)^2 = 4(\delta_{d2} - \delta_{d1})^2 + (\delta_{p2} - \delta_{p1})^2 + (\delta_{h2} - \delta_{h1})^2 \quad (1)$$

wherein $R_a$=distance in HSP space between compound 1 and compound 2 ($MPa^{0.5}$)

$\delta_{d1}$, $\delta_{p1}$, $\delta_{h1}$=Hansen (or equivalent) parameter for compound 1 (in $MPa^{0.5}$)

$\delta_{d2}$, $\delta_{p2}$, $\delta_{h2}$=Hansen (or equivalent) parameter for compound 2 (in $MPa^{0.5}$)

Thus, the smaller the value for $R_a$ for a given solvent calculated with respect to the compound to be recovered (i.e., the compound to be recovered being compound 1 and the solvent being compound 2, or vice versa), the higher the affinity of this solvent for the compound to be recovered will be.

Hansen solubility parameters for numerous solvents can be found in, among others, *CRC Handbook of Solubility Parameters and Other Cohesion Parameters, Second Edition* by Allan F. M. Barton, CRC press 1991; *Hansen Solubility Parameters: A User's Handbook* by Charles M. Hansen, CRC press 2007.

The bottom stream from the first extraction column comprises organic solvent and aromatic hydrocarbons and/or polar components, wherein said polar components comprise salts and/or heteroatom containing organic compounds. In addition, said bottom stream may comprise conjugated aliphatic compounds having two or more carbon-carbon double bonds in a case wherein the latter compounds are present in the liquid hydrocarbon feedstock stream.

Preferably, organic solvent is recovered from said bottom stream and then advantageously recycled to the first extraction column. Recovery of organic solvent is illustrated below with reference to a case wherein the bottom stream from the first extraction column comprises organic solvent, aromatic hydrocarbons, conjugated aliphatic compounds having two or more carbon-carbon double bonds, salts, heteroatom containing organic compounds and optionally water. Said water may originate from an optional second solvent stream as further described below and/or from the first solvent stream.

In a first separation step, the above-mentioned bottom stream from the first extraction column may be separated into a stream comprising aromatic hydrocarbons and conjugated aliphatic compounds having two or more carbon-carbon double bonds and a stream comprising organic solvent, salts, heteroatom containing organic compounds, optionally water and optionally aromatic hydrocarbons. The latter separation may be performed by using a decanter. Preferably, in the latter separation step, water is added in addition to any water that may be present in said bottom stream from the first extraction column. Advantageously, the separated aromatic hydrocarbons and conjugated aliphatic compounds having two or more carbon-carbon double bonds may be blended with pygas and processed into fuel or used in the production of aromatic compounds. Further, they may be further separated into various fractions which may be used as a solvent.

The above-mentioned first separation step may be omitted in case the bottom stream from the first extraction column does not comprise aromatic hydrocarbons and conjugated aliphatic compounds having two or more carbon-carbon double bonds or in case aromatic hydrocarbons and conjugated aliphatic compounds having two or more carbon-carbon double bonds are recovered in another way. In case the bottom stream from the first extraction column does comprise aromatic hydrocarbons and conjugated aliphatic compounds having two or more carbon-carbon double bonds, it is preferred to perform the first separation step. In that way, advantageously, there is no need to separate the organic solvent from aromatic hydrocarbons in a later step, for example by means of distillation which is cumbersome and energy consuming.

In a second separation step, in a case wherein the stream comprising organic solvent, salts, heteroatom containing organic compounds, optionally water and optionally aromatic hydrocarbons resulting from the first separation step comprises water, said stream may be separated into a stream comprising water, heteroatom containing organic compounds and optionally aromatic hydrocarbons, in specific aromatic hydrocarbons having a relatively low molecular weight, and a stream comprising organic solvent and salts. Water may be separated in any known way, preferably by distillation. The latter separation may be performed in a distillation column. Water may form an azeotrope with aromatic hydrocarbons, in specific aromatic hydrocarbons having a relatively low molecular weight. In case the bottom stream from the first extraction column does not comprise aromatic hydrocarbons and conjugated aliphatic compounds having two or more carbon-carbon double bonds or in case aromatic hydrocarbons and conjugated aliphatic compounds having two or more carbon-carbon double bonds are recovered in another way, the second separation step (water separation step) may be performed on that bottom stream directly.

In a third separation step, a stream comprising water, heteroatom containing organic compounds and optionally aromatic hydrocarbons which may result from the second separation step may be separated into a stream comprising water and a stream comprising heteroatom containing organic compounds and optionally aromatic hydrocarbons. The latter separation may be performed by using a decanter. Part of the water as separated may be sent back to a distillation column used in the second separation step as a reflux stream, whereas the other part may be recycled as part of the first solvent stream or an optional second solvent stream as further described below.

In a fourth separation step, the stream comprising organic solvent and salts resulting from the second separation step may be separated into a stream comprising organic solvent which may be recycled to the first column as part of the first solvent stream, and a solid or slurry comprising salts which solid or slurry may be disposed of as waste. The latter separation may be performed by using a filter or settler. The stream comprising organic solvent and salts resulting from the second separation step may additionally comprise aromatic hydrocarbons and/or heteroatom containing organic compounds, in specific aromatic hydrocarbons and/or heteroatom containing organic compounds having a relatively high molecular weight. The latter aromatic hydrocarbons and/or heteroatom containing organic compounds may build up in the organic solvent and may be removed therefrom before recycle to the first column, by distillation of a bleed stream which comprises the organic solvent and the latter aromatic hydrocarbons and/or heteroatom containing organic compounds. Alternatively, part of the organic solvent containing the latter aromatic hydrocarbons and/or heteroatom containing organic compounds may be bled from the process together with the above-mentioned solid or slurry comprising salts.

In a case wherein the stream comprising recovered aliphatic hydrocarbons resulting from the liquid-liquid extraction by the organic solvent in the first column (raffinate stream) also comprises organic solvent, it is preferred that organic solvent is separated from the stream comprising recovered aliphatic hydrocarbons and organic solvent and is recycled to the first column. In this way, the recovered aliphatic hydrocarbons are advantageously separated from any organic solvent in the above-mentioned raffinate stream, and the separated organic solvent is advantageously recycled to the first column.

Organic solvent may be separated from the above-mentioned stream comprising recovered aliphatic hydrocarbons and organic solvent in any way, including distillation, extraction, absorption and membrane separation.

In specific, in the above-mentioned case wherein the stream comprising recovered aliphatic hydrocarbons also comprises organic solvent, it is preferred that the present process additionally comprises the steps of providing a second solvent stream which comprises water; contacting at least a portion of the stream comprising recovered aliphatic hydrocarbons and organic solvent with at least a portion of the second solvent stream; and removing at least a portion of the organic solvent from the stream comprising recovered aliphatic hydrocarbons and organic solvent by liquid-liquid extraction of organic solvent with water. The weight ratio of organic solvent in the first solvent stream to water in the second solvent stream may be at least 0.5:1 or at least 1:1 or at least 2:1 or at least 3:1 and may be at most 10:1 or at most 5:1 or at most 3:1 or at most 2:1.

In a first embodiment, the first and second solvent streams are fed to the first column and the second solvent stream is fed to the first column at a position which is higher than the position at which the first solvent stream is fed, resulting in a top stream from the first column comprising recovered aliphatic hydrocarbons. In this first embodiment, the bottom stream from the first extraction column comprises organic solvent, water and aromatic hydrocarbons and/or polar components. Organic solvent and water may be recovered from said bottom stream in a way as described above, and then advantageously be recycled to the first extraction column.

In a second embodiment, the stream comprising recovered aliphatic hydrocarbons and organic solvent is a top stream from the first extraction column which is fed to a second column, the second solvent stream is fed to the second column at a position which is higher than the position at which the top stream from the first extraction column comprising recovered aliphatic hydrocarbons and organic solvent is fed, resulting in a top stream from the second column comprising recovered aliphatic hydrocarbons and a bottom stream from the second column comprising water and organic solvent. Within the present specification, said "second column" may also be referred to as "second extraction column". The above description of temperature and pressure in the first extraction column also applies to the second extraction column.

In the above-mentioned second embodiment, the first solvent stream may comprise water in addition to organic solvent in which case the bottom stream from the first extraction column comprises organic solvent, water and aromatic hydrocarbons and/or polar components. Further, in said second embodiment, the bottom stream from the second extraction column comprising water and organic solvent may be combined with the bottom stream from the first extraction column. Still further, in said second embodiment, organic solvent and water may be recovered from the bottom stream from the first extraction column or from the bottom stream from the second extraction column or from a combination of said two bottom streams in a way as described above, and then advantageously be recycled to the first and second extraction columns.

Advantageously, aliphatic hydrocarbons recovered in the present process as described above, which may comprise varying amounts of aliphatic hydrocarbons within a wide boiling point range, may be fed to a steam cracker without a further pre-treatment, such as treatment with hydrogen (hydrotreating or hydroprocessing) as disclosed in above-mentioned WO2018069794. In addition to being used as a feed to a steam cracker, aliphatic hydrocarbons recovered in the present process as described above may also advantageously be separated into different fractions which each may find a different application, such as diesel, marine fuel, solvent, etc.

Accordingly, the present invention also relates to a process for steam cracking a hydrocarbon feed, wherein the hydrocarbon feed comprises aliphatic hydrocarbons recovered in a process as described above. Further, accordingly, the present invention also relates to a process for steam cracking a hydrocarbon feed, comprising the steps of: recovering aliphatic hydrocarbons from a liquid hydrocarbon feedstock stream in a process as described above; and steam cracking a hydrocarbon feed, wherein the hydrocarbon feed comprises aliphatic hydrocarbons recovered in the preceding step. The hydrocarbon feed to the steam cracking process may also comprise hydrocarbons from another source, other than the present process for the recovery of aliphatic hydrocarbons from a liquid hydrocarbon feedstock stream. Such other source may be naphtha, hydrowax or a combination thereof.

Advantageously, in a case wherein the liquid hydrocarbon feedstock stream comprises aromatic hydrocarbons, polar components, conjugated aliphatic compounds having two or more carbon-carbon double bonds, or a combination thereof, these have already been removed by the present process as described above before feeding recovered hydrocarbons to a steam cracking process. This is particularly advantageous in that said removed compounds and components, especially polycyclic aromatics, can no longer cause fouling in the preheat, convection and radiant sections of a steam cracker and in the downstream heat exchange and/or separation equipment for a steam cracker, for example in transfer line exchangers (TLEs) which are used to rapidly cool the effluent from a steam cracker. When hydrocarbons condense, they may thermally decompose into a coke layer which may cause fouling. Such fouling is a major factor determining the run length of the cracker. Reducing the amount of fouling results in longer run times without maintenance shutdowns, and improved heat transfer in the exchangers.

The steam cracking may be performed in any known way. The hydrocarbon feed is typically preheated. The feed can be heated using heat exchangers, a furnace or any other combination of heat transfer and/or heating devices. The feed is steam cracked in a cracking zone under cracking conditions to produce at least olefins (including ethylene) and hydrogen. The cracking zone may comprise any cracking system known in the art that is suitable for cracking the feed. The cracking zone may comprise one or more furnaces, each dedicated for a specific feed or fraction of the feed.

The cracking is performed at elevated temperatures, preferably in the range of from 650 to 1000° C., more preferably of from 700 to 900° C., most preferably of from 750 to 850° C. Steam is usually added to the cracking zone, acting as a diluent to reduce the hydrocarbon partial pressure and thereby enhance the olefin yield. Steam also reduces the formation and deposition of carbonaceous material or coke in the cracking zone. The cracking occurs in the absence of oxygen. The residence time at the cracking conditions is very short, typically on the order of milliseconds.

From the cracker, a cracker effluent is obtained that may comprise aromatics (as produced in the steam cracking process), olefins, hydrogen, water, carbon dioxide and other hydrocarbon compounds. The specific products obtained depend on the composition of the feed, the hydrocarbon-to-steam ratio, and the cracking temperature and furnace residence time. The cracked products from the steam cracker are then passed through one or more heat exchangers, often referred to as TLEs ("transfer line exchangers"), to rapidly reduce the temperature of the cracked products. The TLEs preferably cool the cracked products to a temperature in the range of from 400 to 550° C.

Figure 2:
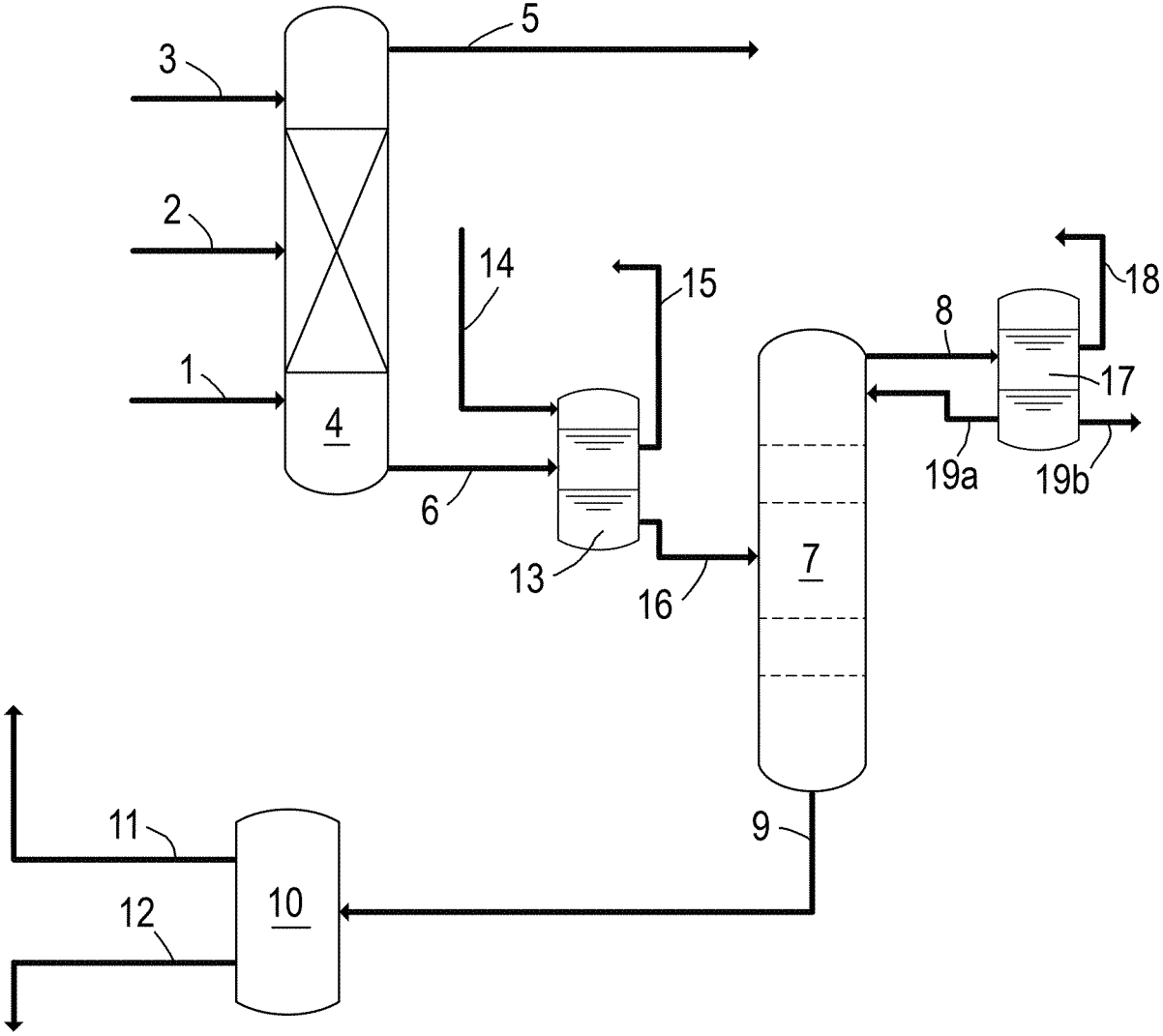
FIG. 2 shows another embodiment of the above-mentioned process.
Figure 3:
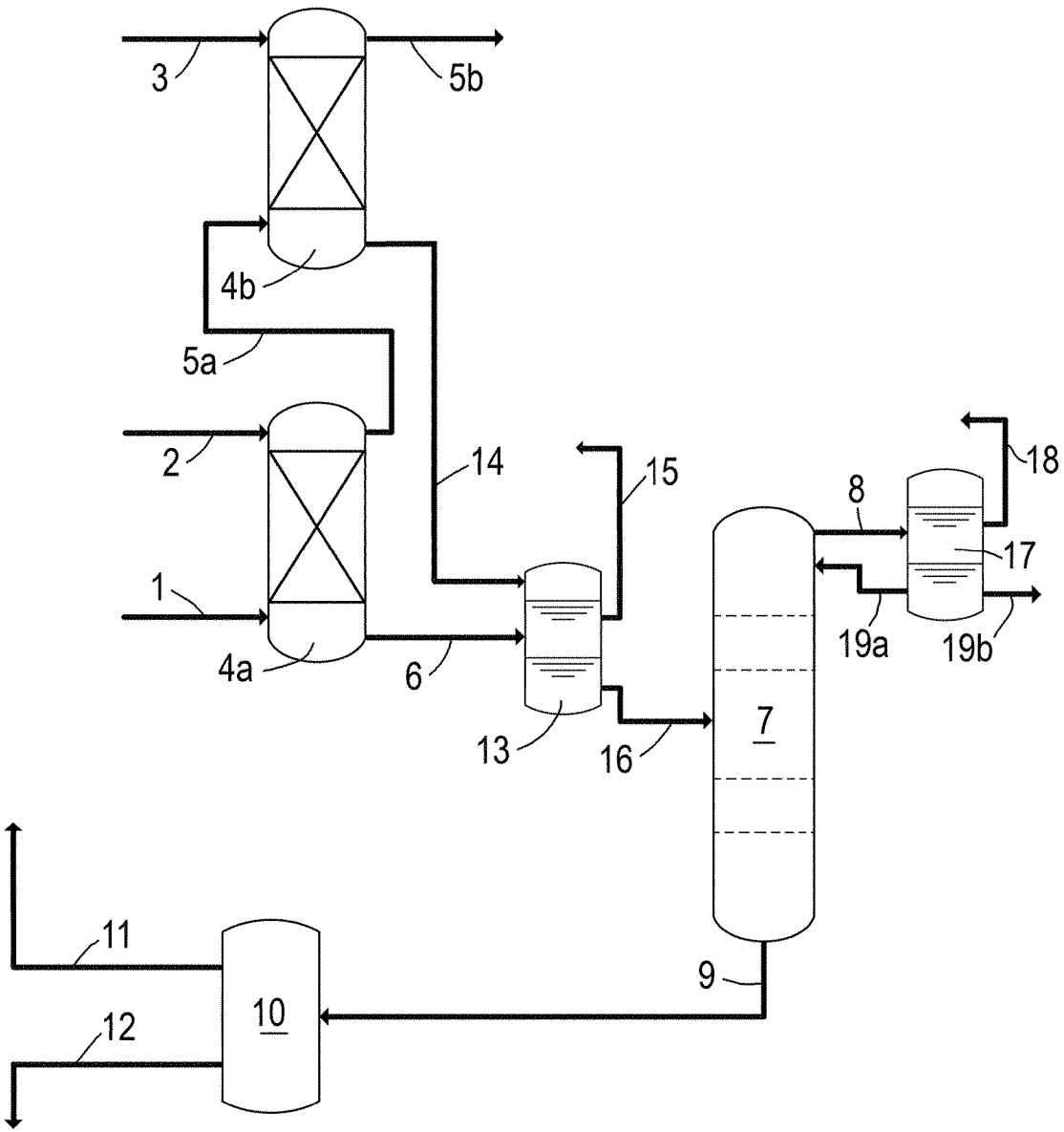
FIG. 3 shows yet another embodiment of the above-mentioned process.

The present process for the recovery of aliphatic hydrocarbons from a liquid hydrocarbon feedstock stream is further illustrated by FIGS. 1, 2 and 3.

In the process of FIG. 1, a liquid hydrocarbon feedstock stream 1, which comprises aliphatic hydrocarbons (including conjugated aliphatic compounds having two or more carbon-carbon double bonds, which are hereinafter referred to as "dienes"), aromatic hydrocarbons, salts and heteroatom containing organic compounds; a first solvent stream 2 which comprises an organic solvent (for example N-methylpyrrolidone); and a second solvent stream 3 which comprises water are fed to a first extraction column 4. In column 4, at least a portion of liquid hydrocarbon feedstock stream 1 is contacted with at least a portion of first solvent stream 2 (organic solvent), thereby recovering at least a portion of the aliphatic hydrocarbons by liquid-liquid extraction of dienes, aromatic hydrocarbons, salts and heteroatom containing organic compounds with the organic solvent, resulting in a stream comprising recovered aliphatic hydrocarbons and organic solvent. Further, at least a portion of the latter stream is contacted with at least a portion of second solvent stream 3 (water), thereby removing at least a portion of the organic solvent by liquid-liquid extraction of organic solvent with water. A stream 5 comprising recovered aliphatic hydrocarbons exits column 4 at the top. Further, a stream 6 comprising organic solvent, water, dienes, aromatic hydrocarbons, salts and heteroatom containing organic compounds exits column 4 at the bottom. Stream 6 is fed to a distillation column 7, where it is separated into a top stream 8 comprising water, dienes, aromatic hydrocarbons and heteroatom containing organic compounds and a bottom stream 9 comprising organic solvent and salts. Stream 8 is fed to an overhead decanter 17, wherein it is separated into a stream 18 comprising dienes, aromatic hydrocarbons and heteroatom containing organic compounds and a stream comprising water, part of which water stream (stream 19*a*) is sent back to distillation column 7 as a reflux stream whereas the other part (stream 19*b*) is recycled (not shown) as part of second solvent stream 3. Stream 9 is fed to a filter 10, where it is separated into a stream 11 comprising organic solvent and a slurry 12 comprising salts. Stream 11 is recycled (not shown) as part of first solvent stream 2.

In the process of FIG. 2, a liquid hydrocarbon feedstock stream 1, which comprises aliphatic hydrocarbons (including conjugated aliphatic compounds having two or more carbon-carbon double bonds, which are hereinafter referred to as "dienes"), aromatic hydrocarbons, salts and heteroatom containing organic compounds; a first solvent stream 2 which comprises an organic solvent (for example N-methylpyrrolidone); and a second solvent stream 3 which comprises water are fed to a first extraction column 4. In column 4, at least a portion of liquid hydrocarbon feedstock stream 1 is contacted with at least a portion of first solvent stream 2 (organic solvent), thereby recovering a portion of the aliphatic hydrocarbons by liquid-liquid extraction of dienes, aromatic hydrocarbons, salts and heteroatom containing organic compounds with the organic solvent, resulting in a stream comprising recovered aliphatic hydrocarbons and organic solvent. Further, at least a portion of the latter stream is contacted with at least a portion of second solvent stream 3 (water), thereby removing at least a portion of the organic solvent by liquid-liquid extraction of organic solvent with water. A stream 5 comprising recovered aliphatic hydrocarbons exits column 4 at the top. Further, a stream 6 comprising organic solvent, water, dienes, aromatic hydrocarbons, salts and heteroatom containing organic compounds exits column 4 at the bottom. Stream 6 is fed to a decanter 13, to which a stream 14 comprising additional water is also fed. In decanter 13, the combined streams 6 and 14 are separated into a stream 15 comprising dienes and aromatic hydrocarbons and a stream 16 comprising organic solvent, water, dienes, aromatic hydrocarbons, salts and heteroatom containing organic compounds. Stream 16 is fed to a distillation column 7. In respect of the treatment in distillation column 7 and further, downstream treatments in the process of FIG. 2 reference is made to the above description of the corresponding treatments in the process of FIG. 1.

In the process of FIG. 3, a liquid hydrocarbon feedstock stream 1, which comprises aliphatic hydrocarbons (including conjugated aliphatic compounds having two or more carbon-carbon double bonds, which are hereinafter referred to as "dienes"), aromatic hydrocarbons, salts and heteroatom containing organic compounds; and a first solvent stream 2 which comprises an organic solvent (for example N-methylpyrrolidone) and water are fed to a first extraction column 4*a*. In column 4*a*, at least a portion of liquid hydrocarbon feedstock stream 1 is contacted with at least a portion of first solvent stream 2 (organic solvent and water), thereby recovering a portion of the aliphatic hydrocarbons by liquid-liquid extraction of dienes, aromatic hydrocarbons, salts and heteroatom containing organic compounds with the organic solvent, resulting in a top stream 5*a* comprising recovered aliphatic hydrocarbons and organic solvent and a bottom stream 6 comprising organic solvent, water, dienes, aromatic hydrocarbons, salts and heteroatom containing organic compounds. Stream 5*a* and a second solvent stream 3 which comprises water are fed to a second extraction column 4*b*. In column 4*b*, at least a portion of stream 5*a* is contacted with at least a portion of second solvent stream 3 (water), thereby removing at least a portion of the organic solvent by liquid-liquid extraction of organic solvent with water. A stream 5*b* comprising recovered aliphatic hydrocarbons exits column 4*b* at the top. Further, a stream 14 comprising organic solvent and water exits column 4*b* at the bottom. Streams 6 and 14 are fed to a decanter 13. In respect of the treatment in decanter 13 and further, downstream treatments in the process of FIG. 3 reference is made to the above description of the corresponding treatments in the process of FIG. 2.

That we claim:

1. A process for steam cracking a hydrocarbon feed, the process comprising:

recovering aliphatic hydrocarbons from a liquid hydrocarbon feedstock stream to produce recovered aliphatic hydrocarbons, wherein the liquid hydrocarbon feedstock stream comprises a liquid product produced by pyrolysis of plastic waste; and steam cracking a hydrocarbon feed which comprises the recovered aliphatic hydrocarbons, wherein the liquid hydrocarbon feedstock stream comprises aliphatic hydrocarbons, polar components and optionally aromatic hydrocarbons, wherein the aliphatic hydrocarbons comprise paraffinic and olefinic aliphatic hydrocarbons, wherein the polar components comprise heteroatom containing organic compounds and optionally salts, wherein the heteroatom containing organic compounds contain one or more heteroatoms and comprise oxygen containing organic compounds, nitrogen containing organic compounds and halogen containing organic compounds, and wherein the amount of the polar components is at least 0.5 wt. % and the amount of the optional aromatic hydrocarbons is at most 20 wt. %, wherein recovering aliphatic hydrocarbons from the liquid hydrocarbon feedstock stream comprises the steps of:

feeding the liquid hydrocarbon feedstock stream to a first column;

feeding a first solvent stream which comprises an organic solvent to the first column at a position which is higher than the position at which the liquid hydrocarbon feedstock stream is fed, wherein the organic solvent in the first solvent stream contains one or more heteroatoms;

contacting at least a portion of the liquid hydrocarbon feedstock stream with at least a portion of the first solvent stream; and recovering at least a portion of the aliphatic hydrocarbons by liquid-liquid extraction of the polar components and optionally the aromatic hydrocarbons with the organic solvent, resulting in a top stream from the first column comprising the recovered aliphatic hydrocarbons and a first portion of the organic solvent and a bottom stream from the first column comprising a second portion of the organic solvent, the polar components, and optionally the aromatic hydrocarbons;

feeding the top stream from the first column to a second column;

feeding a second solvent stream which comprises water to the second column at a position which is higher than the position at which the top stream from the first column is fed;

contacting at least a portion of the top stream from the first column with at least a portion of the second solvent stream; and removing at least a portion of the organic solvent from the top stream from the first column by liquid-liquid extraction of the organic solvent with water, resulting in a top stream from the second column comprising the recovered aliphatic hydrocarbons and a bottom stream from the second column comprising water and the organic solvent.

2. Process according to claim 1, wherein the weight ratio of aliphatic hydrocarbons having a boiling point of from 30 to 300° C. to aliphatic hydrocarbons having a boiling point of from greater than 300 to 600° C. in the liquid hydrocarbon feedstock stream is of from 99:1 to 1:99.

3. Process according to claim 1, wherein the organic solvent in the first solvent stream is selected from the group consisting of diols and triols, including monoethylene glycol, monopropylene glycol and any isomer of butanediol; glycol ethers, including oligoethylene glycols, including diethylene glycol and tetraethylene glycol, and ethers thereof, including diethylene glycol dimethylether; amides, including N-alkylpyrrolidone, including N-methylpyrrolidone, and dialkyl formamide, including dimethyl formamide; dialkylsulfoxide including dimethylsulfoxide; sulfolane; N-formyl morpholine; and furan ring containing components, including furfural, 2-methyl-furan and furfuryl alcohol.

4. Process according to claim 1, wherein the organic solvent in the first solvent stream has an $R_{a,heptane}$ of at least 10 $MPa^{1/2}$ or at least 15 $MPa^{1/2}$ and a difference in $R_{a,heptane}$ compared to $R_{a,toluene}$ of at most 4.5 $MPa^{1/2}$ or at most 4 $MPa^{1/2}$, wherein $R_{a,heptane}$ and $R_{a,toluene}$ refer to the Hansen solubility parameter distance with respect to heptane and toluene, respectively, as determined at 25° C.

* * * * *